US005149093A

United States Patent [19]

Schilling et al.

[11] Patent Number: 5,149,093

[45] Date of Patent: * Sep. 22, 1992

[54] AMUSEMENT DEVICE WITH TRADING CARD DISPENSER

[75] Inventors: Winston H. Schilling, Park Ridge; Mark D. Ritchie, Carol Stream; John Krutsch; Joseph Joos, both of Chicago, all of Ill.

[73] Assignee: Williams Electronics Games, Inc., Chicago, Ill.

[ * ] Notice: The portion of the term of this patent subsequent to Aug. 11, 2009 has been disclaimed.

[21] Appl. No.: 819,104

[22] Filed: Jan. 9, 1992

Related U.S. Application Data

[63] Continuation of Ser. No. 669,385, Mar. 14, 1991, Pat. No. 5,137,278.

[51] Int. Cl.[5] ..... A63F 7/02; A63F 7/36

[52] U.S. Cl. ..... 273/118 A; 273/119 A; 273/121 A

[58] Field of Search ..... 273/108, 118 R, 118 A, 273/119 R, 119 A, 119 B, 120 R, 120 A, 121 R, 121 A, 121 B, 121 D, 121 E, 122 R, 122 A, 123 R, 123 A, 124 R, 124 A, 125 R, 125 A

[56] References Cited

U.S. PATENT DOCUMENTS

| | | | |
|---|---|---|---|
| 2,003,349 | 6/1935 | Dumble | 273/121 A |
| 2,012,502 | 8/1935 | Fey | 273/121 A |
| 2,046,084 | 6/1936 | Moloney | 273/121 A |
| 2,926,915 | 3/1960 | Johns | 273/118 A |
| 3,476,391 | 11/1969 | Fejko | 273/124 R |
| 3,879,037 | 4/1975 | Cooke . | |
| 3,883,139 | 5/1975 | Morrison . | |
| 3,953,027 | 4/1976 | Katzman et al. . | |
| 4,216,961 | 8/1980 | McQuillan . | |
| 4,272,001 | 6/1981 | Horniak . | |
| 4,750,743 | 6/1988 | Nicoletti . | |
| 4,877,244 | 10/1989 | Burrows . | |
| 4,936,579 | 6/1990 | Barlow . | |
| 4,993,587 | 2/1991 | Abe . | |

FOREIGN PATENT DOCUMENTS

| | | | |
|---|---|---|---|
| 2591010 | 6/1987 | France | 273/121 A |
| 2133994 | 8/1084 | United Kingdom | 273/121 A |

*Primary Examiner*—V. Millin
*Assistant Examiner*—Raleigh W. Chiu
*Attorney, Agent, or Firm*—Rockey, Rifkin and Ryther

[57] ABSTRACT

An amusement game operates in conjunction with a trading card dispenser to dispense trading cards to game players who achieve predetermined game objectives through skill during the course of game play.

5 Claims, 4 Drawing Sheets

AMUSEMENT DEVICE WITH TRADING CARD DISPENSER

This is a continuation of copending application Ser. No. 07/669,385 filed on Mar. 14, 1991, now U.S. Pat. No. 5,137,278.

BACKGROUND AND OBJECTS OF THE INVENTION

The present invention relates to amusement devices, and more particularly, to a trading card dispenser for use with such devices.

Typically, amusement devices employ player operated controls, which are used either to manipulate a ball on a playfield (for example, pinball games and the like) or control the movement of an image on a video screen. A game providing additional novelty and player appeal is desirable.

It is well-known in the art to link performance during play of the game to a reward, such as bonus plays or additional points for achieving a specific objective. These type of rewards, however, are of limited utility in stimulating player interest in games designed to simulate sporting events such as baseball, football, basketball, etc. Development of new and exciting rewards for successfully achieving objectives of the game are desirable.

Accordingly, it is an object of the present invention to provide an amusement device that provides enhanced player appeal and entertainment value.

It is a further object of the invention to provide such an amusement device that provides a reward for achieving game objectives through the skill of the game player.

It is yet another object of the invention to provide such rewards in the form of trading cards to stimulate player interest.

These objects, as well as others, will become apparent to those skilled in the art from the detailed description of the invention provided below.

SUMMARY OF THE INVENTION

The present invention is an amusement device having an integral trading card dispenser. Upon achieving predetermined game objectives, the game dispenses a trading card as a reward to the game player.

DETAILED DESCRIPTION OF THE PREFERRED EMBODIMENT

Figure 1:
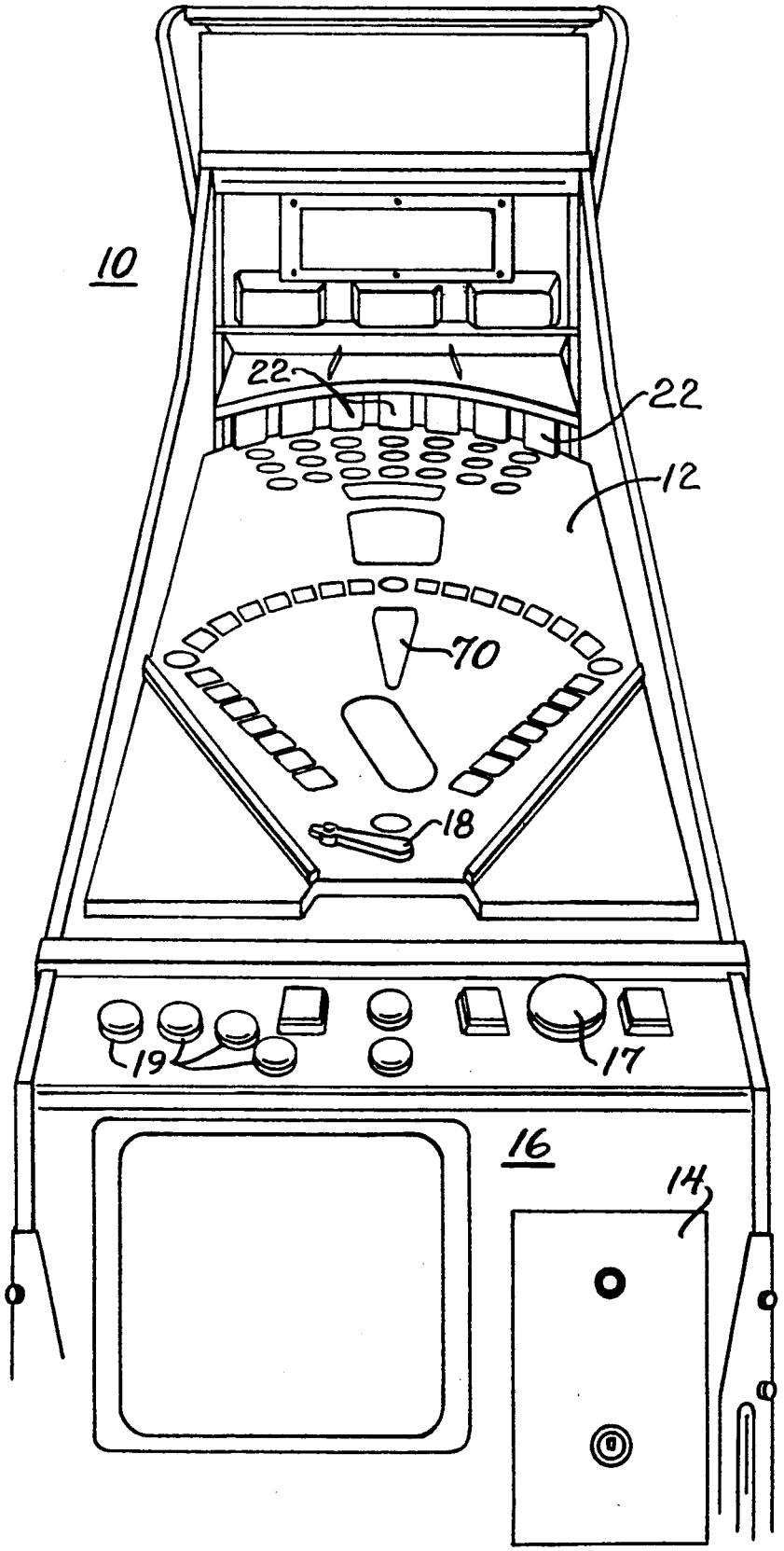
FIG. 1 is a perspective view of a rolling ball game with a card dispenser according to the present invention.

FIG. 1 shows an amusement device 10 having a playfield 12 and a trading card dispenser 14 installed in a game cabinet 16. In the illustrated embodiment, the playfield 12 is configured to resemble a baseball diamond. A player-operated batting mechanism 18 allows a player to hit a ball pitched from a player-operated pitching mechanism 20. The perimeter of the playfield 12 has a series of targets 22 corresponding to various play outcomes in the game of baseball. Each target is associated with a playfield switch which signals the game microprocessor when the target is struck. The outcome of a given play is determined when the batted ball strikes one of the targets 22. Preferably, play is conducted according to the rules of baseball. The card dispenser 14 operates under control of the game microprocessor to dispense a trading card when the player, through skill, achieves a predefined game objective, such as hitting a home run, winning a game, reaching a certain score or at the end of game play as a token prize.

Figure 2:
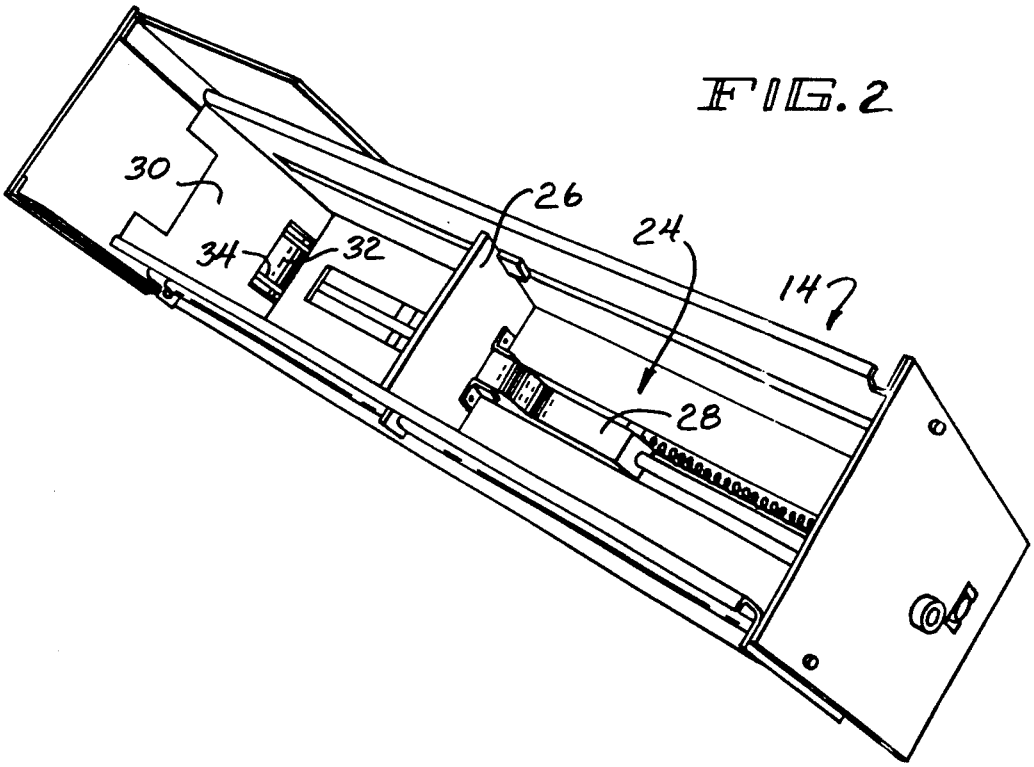
FIG. 2 is a perspective view generally showing the top of the card dispenser according to the present invention.

FIGS. 2–5 show a card dispenser 14 according to the present invention. Referring to FIG. 2, a card magazine 24 is provided for supporting a plurality of individual trading cards 25 (see FIG. 3). A pressure plate 26, which is attached to a plastic support member 28, biases the stack of trading cards toward a front wall 30 of the magazine 24. The front wall 30 has a rectangular aperture substantially in the bottom center to allow a card roller 32 to rollingly engage the first trading card in the magazine 24. A plurality of O-rings 34 (preferably 4) are concentrically disposed about the card roller 32 to frictionally engage the first trading card when driven by a motor (fully described hereinafter), causing it to be dispensed to the game player.

Figure 3:
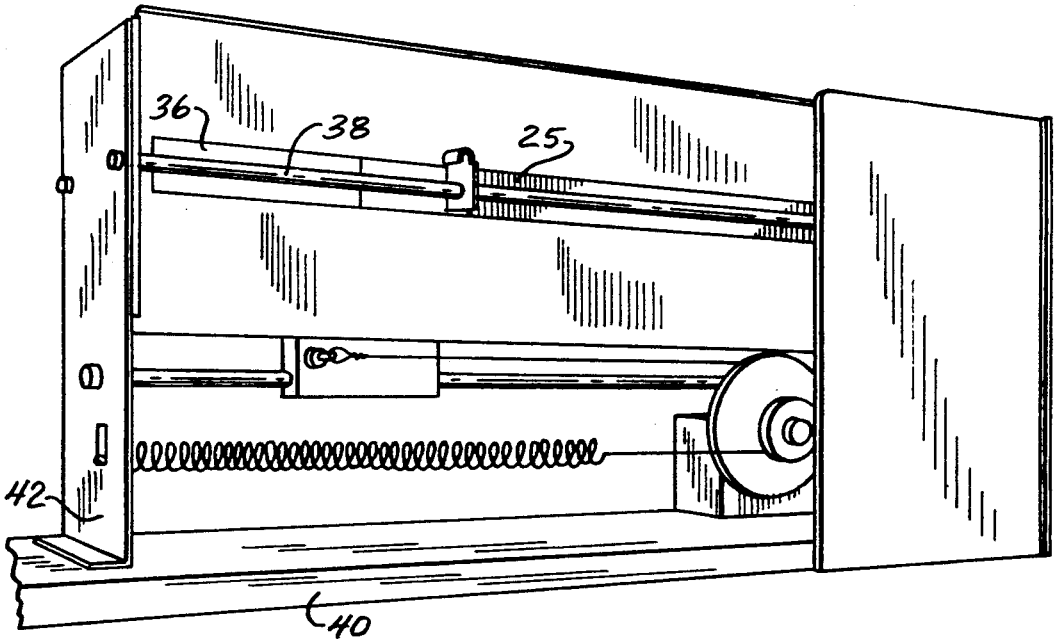
FIG. 3 is a perspective view generally showing the side of the card dispenser according to the present invention.

As can be seen clearly in FIG. 3, the pressure plate 26 is secured for slidable motion in a pair of channels 36, one in each of the side walls of the magazine 24. Each channel is traversed by a guide rail 38, which passes through an aperture in the pressure plate 26. The magazine 24 is supported by a base 40 and a support member 42. The base 40 also supports the mechanism for biasing the trading cards 25 toward the front wall 30 of the magazine 24.

Figure 4:
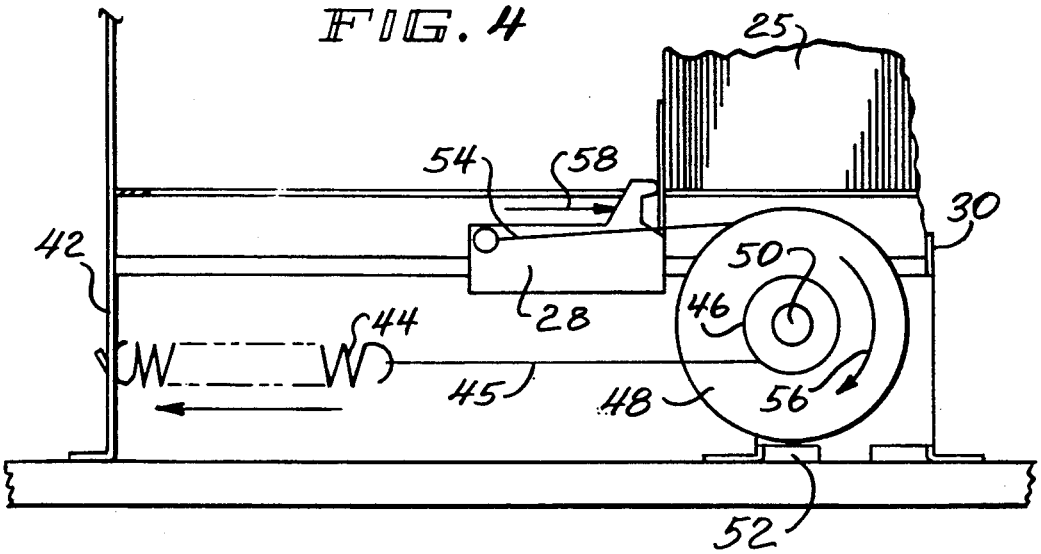
FIG. 4 is a side view of the card dispenser according to the present invention.

FIG. 4 is useful in explaining the biasing mechanism. A spring 44 is secured to the support member 42. The distal end of the spring 44 is connected to a cord 45, which in turn is connected to a pulley 46. The pulley 46 is integral with a larger pulley 48. Both pulleys are mounted for rotational motion about a common axis 50 on a support member 52. The pulley 48 has a larger diameter than the pulley 46 to allow increased force to be applied to bias the trading cards 25 toward the front wall 30 because of the mechanical advantage obtained thereby. A cord 54 connects the pulley 48 to the plastic support member 28, which supports the pressure plate 26. As will be apparent to one having ordinary skill in the art, the spring 44 biases the pulleys for rotation as shown by arrow 56. Thus, the pressure plate 26 is biased in the direction of arrow 58, urging the trading cards 25 toward the front wall 30. Because of this biasing action, a trading card is always ready to be dispensed to the game player.

Figure 5:
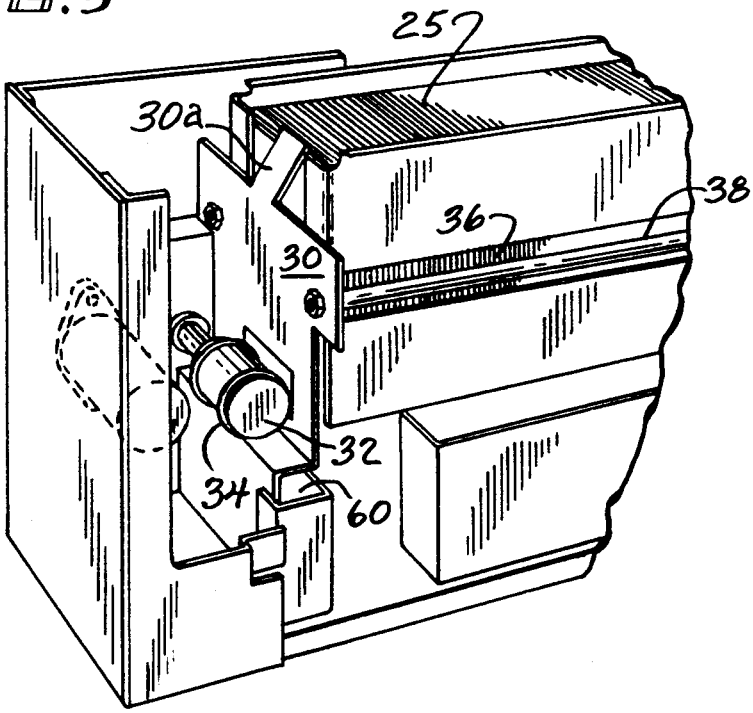
FIG. 5 is a perspective view generally showing the card dispensing means of the present invention.

FIG. 5 shows how the card dispenser of the present invention dispenses a card to the game player. As previously noted, the card roller 32 engages the first trading card 25 from the stack contained in the magazine 24 via the O-rings 34. The card roller is rotatably secured to the shaft of an electric motor (not shown). Upon command of the system microprocessor, the motor begins to turn in the clockwise direction, causing the first trading card to be pulled downwardly from the stack. The front wall 30 may be constructed to include a finger portion 30*a*, which may be bent rearwardly to prevent the trading cards 25 from engaging the entire surface area of the front wall 30. This ensures that the card roller 32 generates sufficient force to reliably pull a single trading card from the stack each time the motor is activated. The card falls through a passageway 60 into a holding tray 62 (not shown), where it is retrieved by the game player. An optical switch of the type commonly known in the art is disposed in the passageway 60. When the trading card passes through the optical switch, the microprocessor is signalled to de-energize the motor. The spring biasing mechanism forces the next trading card into frictional engagement with the card roller 32, as previously described.

The pressure plate 26 travels toward the front wall 30 as cards are dispensed from the magazine 24. The distance between the pressure plate 26 and the front wall 30 is directly proportional to the number of trading cards 25 remaining in the magazine 24. A switch may be disposed along the path of travel of the pressure plate 26 to generate a signal (for example, lighting a lamp on the front panel of the card dispenser 24) when the supply of trading cards in the magazine 24 becomes low.

Figure 6:
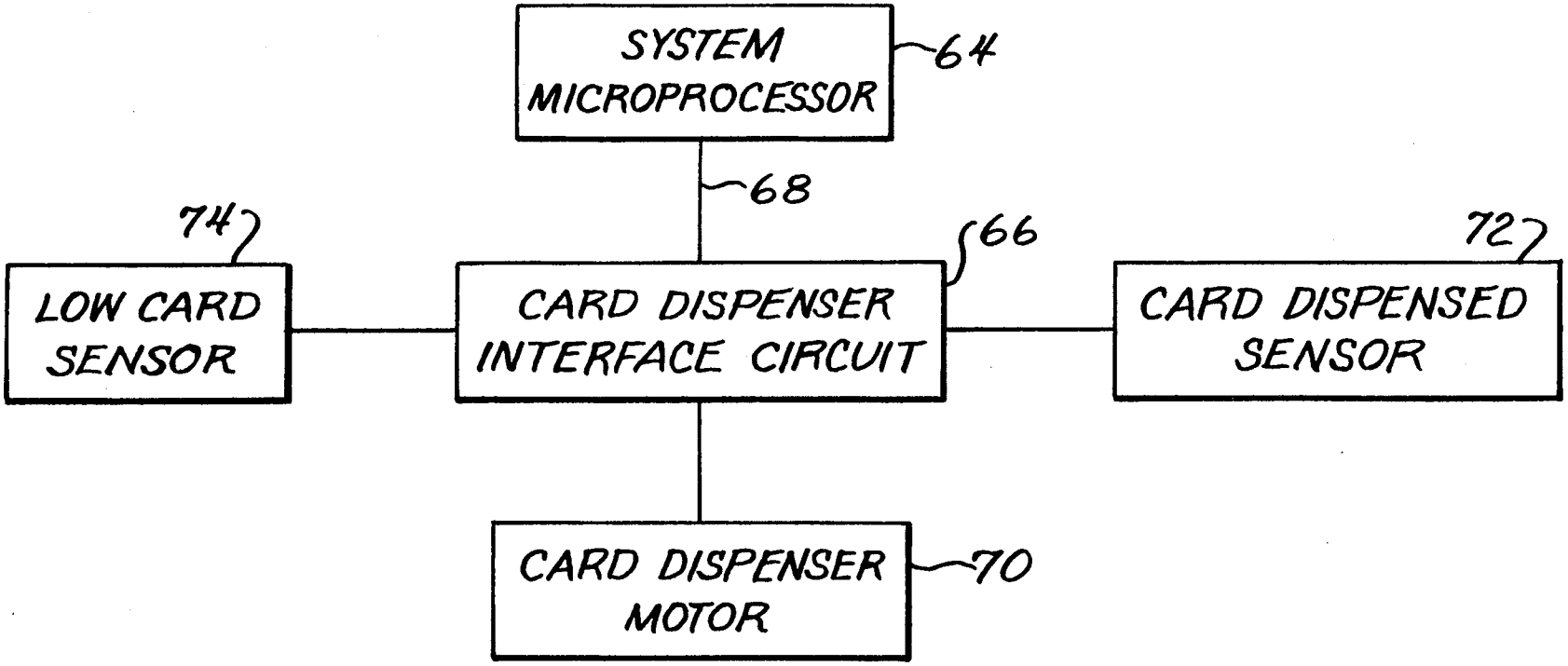
FIG. 6 is a block diagram useful in explaining the operation of the present invention.

FIG. 6 is a block diagram useful in explaining the operation of the present invention. A microprocessor 64, of the type well known in this art, controls overall game operation and communicates with a card dispenser interface circuit 66 via a bus 68. The card dispenser interface circuit 66 has circuitry suitable for driving the card dispenser motor 70 upon command of the microprocessor 64, as previously described. Specifically, the interface circuit 66 includes a transistor which switches a d.c. voltage to power the motor 70 when the base is energized by the microprocessor 64. The interface circuit 66 also includes a transistor switch circuit to signal the microprocessor 64 to de-energize the motor 70 when optical switch 72 detects passage of the trading card 25 being dispensed through the passageway 60 (see FIG. 5). Finally, the interface circuit 66 includes a diode circuit to supply power to a low card signal light upon receipt of a signal from a low card sensor switch 74. Construction of these circuits will be apparent to one of ordinary skill in the art.

It should be noted that the present invention will be described for purposes of example as simulating the game of baseball; however, the play of any amusement game, including other sporting games or games not subject to any predetermined body of rules, may be enhanced using the teachings of the present invention. Similarly, the teachings of the present invention are applicable to video games as well as rolling ball games.

In operation of the disclosed embodiment, game play is initiated by insertion of coins into the game. The player then operates the switch 17 which controls batting mechanism 18 (FIG. 1). The pitching mechanism 20 is operated by any one of switches 19 (each corresponding to a different type of pitch) by the same or another game player. If, during the course of game play, certain predetermined game objectives are achieved, the microprocessor 64 signals the card dispenser interface circuit 66 to dispense one or more trading cards. Examples of game objectives for which a player may be awarded a trading card are hitting a grand-slam home run, pitching a shut out, high score to date, etc. Similar objectives may be used for games simulating other sports. Obviously, the trading cards could relate to any subject matter, including the particular game simulated by the amusement device.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. In combination:

a coin operated amusement game including player operated controls associated therewith and a game microprocessor for receiving inputs from the player-operated controls to monitor the progress of the player in achieving game objectives, and;

a trading card dispenser for dispensing trading cards to a game player responsive to signals from the game microprocessor when predetermined game objectives are achieved.

2. The combination game of claim 1 wherein the card dispenser further comprises:

a) a magazine for storing a plurality of individual trading cards;

b) biasing means for biasing said plurality of trading cards toward a first end of said magazine, and;

c) means for frictionally engaging said trading cards to dispense them responsive to said game microprocessor.

3. The combination of claim 2 wherein said means for frictionally engaging includes a cylinder and means for rotating the cylinder, said magazine having an aperture in said first end to allow contact between said cylinder and said trading cards.

4. The combination of claim 1 wherein said card dispenser further includes switch means for detecting and signalling depletion of said plurality of trading cards, to said microprocessor.

5. The combination of claim 2 wherein said first end of said magazine includes portions defining a rearwardly extending finger for preventing the trading cards from engaging the full surface area of said first end.

* * * * *

UNITED STATES PATENT AND TRADEMARK OFFICE

CERTIFICATE OF CORRECTION

PATENT NO. : 5,149,093

DATED : September 22, 1992

INVENTOR(S) : Mark D. Ritchie, et al

It is certified that error appears in the above-identified patent and that said Letters Patent is hereby corrected as shown below:

On the title page under Item [19]: "Schilling" should read --Ritchie--.
On the title page, Item [75] --Mark D. Ritchie-- should read as the first named inventor.

Signed and Sealed this

Twenty-first Day of September, 1993

Bruce Lehman

*Attest:*

BRUCE LEHMAN

*Attesting Officer*

*Commissioner of Patents and Trademarks*